United States Patent [19]

Tipton

[11] 4,383,398

[45] May 17, 1983

[54] INSULATION DISPENSING CAGE

[76] Inventor: James A. Tipton, 1243 Browns Ferry Rd., Chattanooga, Tenn. 37419

[21] Appl. No.: 174,545

[22] Filed: Aug. 1, 1980

[51] Int. Cl.[3] ..... E04G 21/00

[52] U.S. Cl. ..... 52/743; 52/749; 156/577; 242/55

[58] Field of Search ..... 52/743, 746, 749; 242/55, 55.2; 156/71, 577

[56] References Cited

U.S. PATENT DOCUMENTS

| | | | |
|---|---|---|---|
| 701,727 | 6/1902 | Holmes | 156/577 |
| 802,292 | 10/1905 | Howell | 156/577 |
| 3,016,973 | 1/1962 | Williamson | 182/63 |
| 3,379,281 | 4/1968 | Calletti | 182/63 |
| 3,969,863 | 7/1976 | Alderman | 52/743 |
| 3,992,847 | 11/1976 | Heath | 52/743 |
| 4,078,355 | 3/1978 | Clemensen | 52/749 |
| 4,105,490 | 8/1978 | Lass | 156/577 |
| 4,210,485 | 7/1980 | Lake | 156/577 |
| 4,222,212 | 9/1980 | Alderman | 52/749 |
| 4,261,789 | 4/1981 | Spataro | 156/577 |

*Primary Examiner*—Alfred C. Perham
*Assistant Examiner*—Henry E. Raduazo
*Attorney, Agent, or Firm*—Alan Ruderman

[57] ABSTRACT

A cage for carrying workmen for dispensing and installing insulation wound in a roll onto a vertical portion of a building includes a platform on the underside of which a pair of spaced channels are disposed for receiving the fork tines of a forklift for elevating the cage. The top of the cage includes a first pair of support members for carrying the end portions of a horizontally disposed mandrel about which a first roll of insulation is wound and a second pair of support members for carrying the ends of a second insulation roll carrying mandrel, the second support members and roll being movable from a lower operative position to a stand-by position. A horizontally disposed guide member is spaced from the mandrel and includes a guide surface and a hold-down member between which the insulation may be dispensed. The leading edge of the insulation is secured to the building and the cage is elevated vertically while feeding the insulation from the roll, the insulation being secured to the building at the elevated position.

3 Claims, 3 Drawing Figures

INSULATION DISPENSING CAGE

BACKGROUND OF THE INVENTION

This invention relates to a construction aid for installing insulation on the exterior of a building and more particularly to a cage for supporting and dispensing the insulation and the method therefor.

In the errection of prefabricated metal buildings and the like after the structural frame members are errected fiberglass insulation is installed over the frame prior to placement and mounting of the exterior sheet metal sidewall panels. Conventionally, the wall insulation is installed by workmen supported on scaffolding. The scaffolding must be assembled, moved and reassembled as the workmen progress up and down the building. The insulation is wound in large rolls which must be moved by the workmen along with the scaffolding. The set-up time and moving of the scaffolding results in a reduction of efficiency and this substantial ineffective utilization of the workmen adds to the cost of construction.

SUMMARY OF THE INVENTION

Consequently, it is a primary object of the present invention to provide a cage adapted to support at least one workman and having insulation roll dispensing means for readily dispensing the insulation, and which cage includes means for cooperating with an elevating lift.

It is another object of the present invention to provide a cage that can be supported on and elevated by a forklift and which includes means for carrying one or more rolls of insulation and for dispensing the insulation vertically as the cage is elevated.

To this end the present invention provides a cage including a platform having spaced tine receiving channels for receiving the fork tines of a forklift and which can support at least one workman as the cage is elevated. A feature of the cage includes means on the top of the cage for carrying the end portions of an insulation roll supporting mandrel, and a guide member over which the insulation may be dispensed. A means for holding a dispensed portion of the insulation against the guide member is also provided so that the insulation remains in contact with the guide member despite wind gusts.

A further feature of the invention is the provision of means for supporting the end portions of a second insulation roll supporting mandrel on the top of the cage and which is elevationally adjustable so that the second roll of insulation can be supported above the cage when the first roll of insulation is in place.

The invention also provides a method of installing the insulation on the exterior frame of a building including the steps of mounting a roll of insulation on a mandrel with the free end of the insulation disposed downwardly over the guide member, securing the free end of the insulation to a lower portion of the building, elevating the cage and securing the insulation at an elevated location on the building, and thereafter further elevating the cage and securing the insulation until the insulation substantially covers a vertical length of the building frame the width of the roll.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
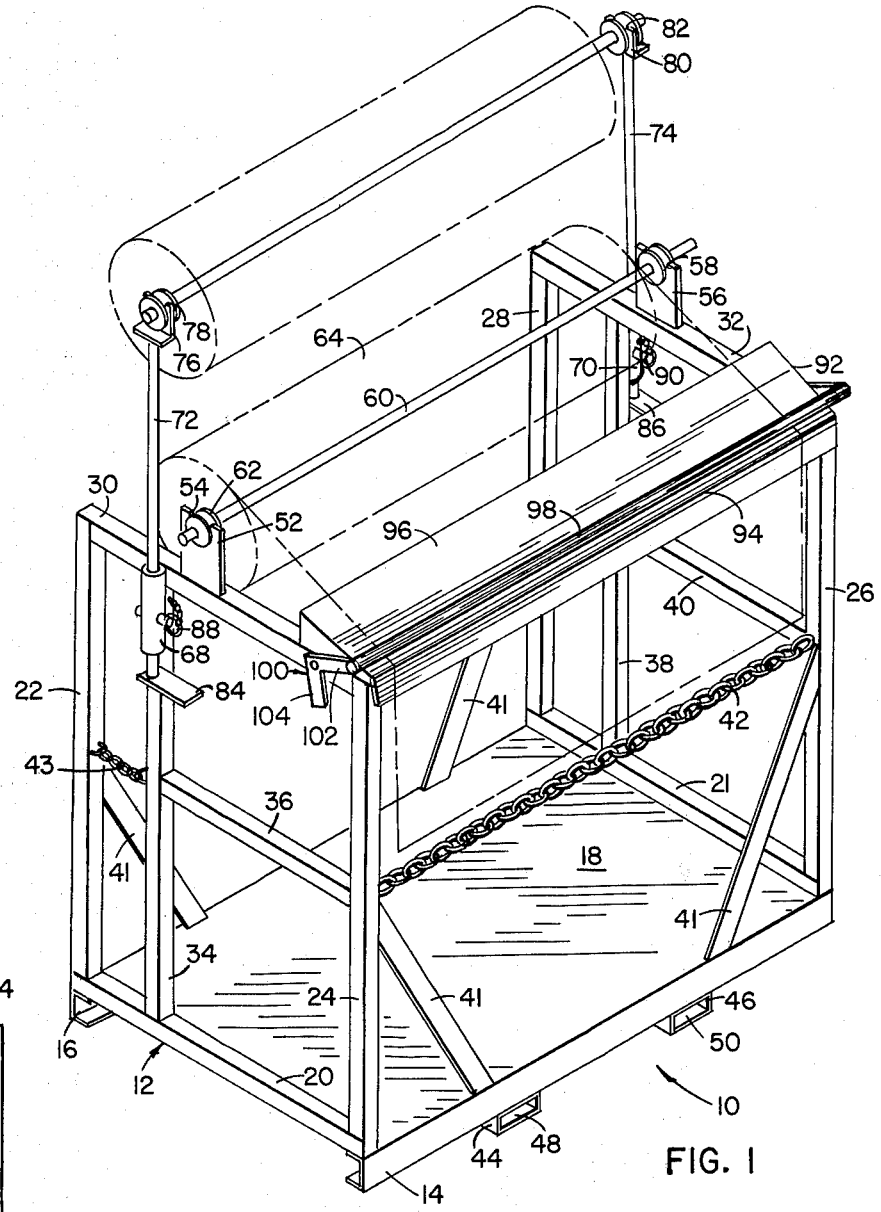
FIG. 1 is a perspective view of the preferred form of an insulation dispensing cage adapted for use with a forklift, the cage being constructed in accordance with the principles of the present invention.
Figure 3:
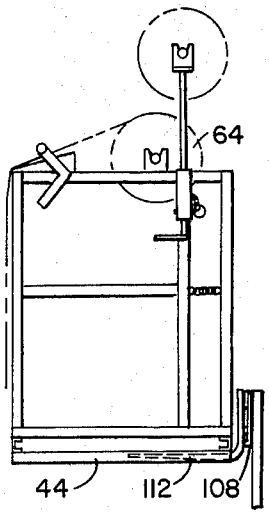
FIG. 3 is a view similar to FIG. 2 but with only the elevating portion of the forklift illustrated and in a raised position.

Referring to FIG. 1, a cage 10 constructed in accordance with the present invention includes a platform generally indicated at 12 and comprising a pair of laterally spaced structural beam members 14,16 which as illustrated may be a pair of structural steel channel members having the channel flanges facing each other. Mounted on the upper flanges of the members 14,16 is a planar floor member 18 of sufficient strength for supporting at least one and preferably two workmen. The floor member 18, as illustrated, may be of a rectangular configuration supported on the members 14,16 along a pair of laterally spaced edges and carries a respective beam 20 and 21 on the upper surface thereof along each of the other edges substantially normal to the members 14,16.

Extending vertically upwardly from the upper surface at each extremity of each of the beams 20,21 is a post member 22,24 and 26,28 respectively. A beam 30 similar to beam 20 is secured to the upper extremeties of the posts 22 and 24, and a similar beam 32 is secured to the upper extremities of the posts 26 and 28, the beams 30 and 32 being substantially parallel to the floor member 18. The posts 22,24 together with the beams 20 and 30 comprise the frame members of a first end of the cage which may include an upstanding structural member 34 disposed intermediate posts 22 and 24 secured to the beams 20 and 30. The frame may be braced between posts 24 and 34 by a substantially horizontally disposed beam 36 to add structural rigidity to the frame. Similarly the posts 26,28 together with the beams 21 and 32 form a frame at the other end of the cage, and may include an upstanding member 38 intermediate posts 26 and 28, secured as by welding to the horizontal beams 21 and 32. A structurally strengthening beam 40 between the posts 26 and 28 may brace this end of the cage. Additional strength may be provided by angularly extending braces 41 attached to the posts and to the floor. The structural members of the cage thereby provide a structurally secure housing and chain members 42 and 43 may be provided for safety purposes.

Secured beneath the platform 12 to the lowermost flanges of the channels 14 and 16 are a pair of elongated hollow substantially rectangular beam members 44 and 46 which span the underside of the platform substantially parallel to the end frames. The members 44 and 46 may comprise structural channel members having plates welded to the free ends of the flanges to define channels 48 and 50 respectively, which channels are spaced apart by an amount substantially equal to the spacing between the fork tines of a forklift for purposes as hereafter described.

Secured to the upper surfaces of the beam 30 intermediate the posts 22 and 24 is a bracket member 52 having a substantially V-shaped cut-out 54 in the plane of the end frame. Another upstanding bracket member 56 is secured on the beam 32 intermediate the post 26 oppositely disposed to the bracket 52. The bracket 56 includes a V-shaped notch 58 in substantial alignment with the V-shaped slot 54 of the bracket 52 and a mandrel 60 is received within the notches 54 and 58. Roller members 62 may be fitted on the mandrel and positioned on the inclined side walls of the V-shaped slots to reduce rotational friction. A roll of insulation 64 of a width slightly less than the spacing between the end frames may be supported on the mandrel 60 for dispensing as hereinafter described.

Secured to each of the upstanding member 34,38 is a respective vertically extending cylindrical sleeve 68,70, each having its upper edge substantially coextensive with the top surface of the beams 30,32 respectively, and cylindrical rods 72, 74 is received within the respective sleeve 68,70. A bracket member 76 similar to the brackets 52 and 56 is fixed to the top of the rod 72 and includes a V-shaped notch 78, and a similar bracket 80 having a V-notch 82 is fixed to the top of the rod 74. The brackets 76 and 80 are adapted for supporting a mandrel similar to the mandrel 60 for carrying a second roll of insulation. The second roll can be loaded while the rods 72 and 74 are in the lowermost position with the brackets 76 and 80 abutting the beams 30 and 32 and then lifted to a stand-by position out of the way of the roll 64 which is subsequently loaded onto the brackets 52 and 56. To lift the rods 72 and 74 the rods are provided with arms 84 and 86 secured to the respective bottoms of the rods. A lock pin 88 and 90 extending through a hole in the respective sleeve 68,70 and rod 72,74 secures the rods in the raised position supporting the second roll of insulation.

Spanning the beams 30 and 32 is a canopy member 92 including a guide surface 94 lying substantially at the intersection of the post 24,26 and the beams 30,32 respectively. As illustrated, the canopy 92 includes an angularly inclined top surface 96 over which the insulation may be fed as it is unrolled and guided by the surface 94 downwardly from the cage. Alternatively, a cylindrical rod may be utilized in place of the canopy and positioned substantially at the location of the edge 94, satisfactory results having been obtained with that construction.

To hold the leading end of the insulation against the surface 96 as it is unrolled, and thus prevent lifting of the insulation by wind etc., a hold-down member in the form of a rod 98 is provided to engage the surface 94. A bellcrank lever 100 is pivotably mounted at each end of the canopy, one leg 102 of each lever carrying an end of the rod 98. The other leg 104 of the levers 100 can be manually engaged to raise the rod 98 for threading the insulation between the canopy and the rod.

Figure 2:
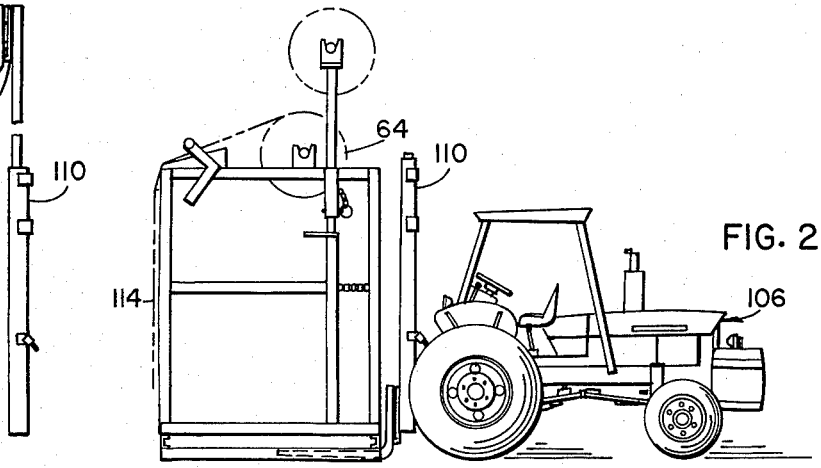
FIG. 2 is a side elevational view of the cage mounted on a forklift with the elevating portion of the forklift in its lowermost position.

Referring now to FIG. 2 a conventional forklift 106 having an elevating gate 108 preferably mounted on an elevating mast 110 is positioned adjacent the cage with the tines 112 of the gate fork disposed within the channels 48 and 50 of the cage. The opening of the channels 48 and 50 are such that the tines are securely received therein and when the gate is elevated so to is the cage.

The free end 114 of the insulation 64 is unrolled over the guide edge 94 and disposed downwardly for dispensing of the insulation from the roll. The cage may be elevated by actuation of the forklift gate 108 and dispensed downwardly from the top of the building to be attached to the building framework. However, in accordance with the method of the present invention the insulation is attached at the bottom of the building while the cage is in the position illustrated in FIG. 2, and secured to a lower portion of the building. The forklift gate is thereafter elevated to a higher vertical position as the insulation is unwound from the roll, and secured to the building, the method continuing until the insulation has been dispensed for the entire height of the building. When the first roll of insulation is spent the second roll is lowered and dispensed in a similar manner.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. The method of installing insulation wound in a roll onto a vertical wall of a building, said method comprising providing a frame having a substantially horizontally disposed mandrel and a canopy having a top surface disposed below said mandrel and inclined relatively thereto, the inclination being such that the top surface slopes downwardly away from said mandrel, said canopy further having a downwardly disposed surface extending from the lowermost portion of said top surface for forming a substantially horizontally disposed guide member at the intersection of said top surface and said downwardly disposed surface, supporting said frame on an elevatable gate of a forklift, mounting said roll on said mandrel, feeding said insulation over said top surface, over said guide member and vertically downwardly over said downwardly disposed surface, securing the free end of the insulation to the building, actuating said elevatable gate of the forklift vertically upwardly while paying out insulation from said roll, and securing the insulation to the building at the elevated position.

2. The method as recited in claim 1, wherein said frame includes a hold-down member moveable relatively to said guide member, said method including moving said hold-down member away from said guide member to thread the free end of the roll of insulation over the guide member, and then moving said hold-down member toward said guide member into engagement with the insulation to hold the insulation against said top surface while permitting the insulation to be fed between said hold-down member and said guide member.

3. The method of installing insulation wound in a roll onto a vertical wall of a building, said method comprising providing a frame having a substantially horizontally disposed mandrel and a substantially horizontally disposed guide member spaced from said mandrel, supporting said frame on an elevatable gate of a forklift, mounting said roll on said mandrel, feeding said insulation over said guide member with the free end of said insulation disposed vertically downwardly, securing the free end of the insulation to the building, actuating said elevatable gate of the forklift vertically upwardly while paying out insulation from said roll, and securing the insulation to the building at the elevated position the method further, including mounting a second roll of insulation on a second substantially horizontally disposed mandrel on said frame in a stand-by position remote from said first roll, repositioning said second mandrel after said first roll is spent to feed the free end of insulation on said second roll over said guide member, continuing to actuate said elevatable gate vertically while paying out insulation from said second roll, and securing the insulation from said second roll to said building.

* * * * *